United States Patent [19]

Matsushiro

[11] 4,180,939

[45] Jan. 1, 1980

[54] HELICOPTER TOY

[75] Inventor: Yukimitsu Matsushiro, Tokyo, Japan

[73] Assignee: K.K. Matsushiro, Tokyo, Japan

[21] Appl. No.: 853,913

[22] Filed: Nov. 22, 1977

[30] Foreign Application Priority Data

Oct. 4, 1977 [JP] Japan ..... 52/132833

[51] Int. Cl.[2] ..... A63H 27/12

[52] U.S. Cl. ..... 46/75; 46/82

[58] Field of Search ..... 46/75, 74 R, 82, 83, 46/84, 85, 206

[56] References Cited

U.S. PATENT DOCUMENTS

| | | | |
|---|---|---|---|
| 2,731,767 | 1/1956 | Holt | 46/82 X |
| 3,161,988 | 12/1964 | Junker | 46/75 |
| 3,798,832 | 3/1974 | Terzian | 46/206 |
| 3,995,392 | 12/1976 | Goldfarb et al. | 46/83 X |

*Primary Examiner*—Louis G. Mancene
*Assistant Examiner*—Mickey Yu
*Attorney, Agent, or Firm*—Ladas, Parry, Von Gehr, Goldstmith & Deschamps

[57] ABSTRACT

A helicopter toy comprising a toy helicopter and a launcher therefor, wherein the helicopter comprises a fuselage and a lift rotor having a shaft which rotatably extends through the fuselage supported thereby, the launcher comprises a driving apparatus and a stand therefor, and the driving apparatus is provided with a hand-operated main driving shaft with a crank handle, an accelerating gear system, a rotation shaft which can transmit rotation to the shaft of the rotor of the helicopter, and a mount on which the fuselage can be mounted so that the lower end of the rotor shaft and the upper part of the rotation shaft may be disengageably engaged, is disclosed.

9 Claims, 9 Drawing Figures

HELICOPTER TOY

BACKGROUND OF THE INVENTION

This invention relates to a helicopter toy, which comprises a toy helicopter and a launcher therefor. More particularly, the invention relates to a combination of a single rotor toy helicopter and a launcher comprising a driving apparatus and a stand, wherein said driving apparatus is manually energized and is disengageably engaged with the shaft of the rotor of the toy helicopter so that rotational energy from the driving apparatus can be imparted to said helicopter rotor and, when the desired rotational speed is reached, the helicopter can be launched as the user wishes.

Toy helicopters comprising a lift rotor and a fuselage, in which the rotor is rotated by means of a string would onto the shaft thereof so as to lift the helicopter, have been known. However, the flying range of such toy helicopters is limited, because high speed rotation of the rotor cannot be attained. Further, the operation of these toy helicopters is not easy, because the helicopter is held by one hand and the string and the rotor is handled by the other hand. Therefore, the user often fails to release the helicopter at the most suitable moment, and thus, some training is required before a user can skillfully control it.

This invention provides a toy helicopter which can be launched without any training by either a right-handed child or a left-handed child, and can be launched in any desired direction to any desired altitude or flying range.

SUMMARY OF THE INVENTION

The helicopter toy of this invention comprises a toy helicopter (hereinafter, simply called "helicopter"), a driving apparatus which transmits rotational energy to the rotor of the helicopter and a stand which supports the driving apparatus, whereby the helicopter is placed on the driving apparatus so that the shaft of the rotor and a rotation shaft of the driving apparatus are engaged, the rotor is rotated by turning the crank handle of the driving apparatus, and the rotor is disengaged from the driving apparatus when the desired rotation speed is attained so as to launch the helicopter. The rotational energy is transmitted to the rotor by means of the rotor shaft which rotatably penetrates through the fuselage supported thereby and is disengageably engaged at its lower end with the rotation shaft of the driving apparatus, which is rotated by turning the crank handle until desired rotation speed is attained. When the helicopter is properly placed on the driving apparatus, the lower end of the rotor shaft engages with the rotation shaft. Further, the driving apparatus is provided with a stopper means, which normally retains but releases the helicopter by hand operation. Therefore, the helicopter can be launched by disengaging the stopper when the rotor has acquired the desired rotation speed.

Further, the driving apparatus upon which the helicopter is placed can be tilted to a desired angle as the rotation shaft (and, therefore, the helicopter rotor, too) is rotating. Therefore, the helicopter can be launched in any desired direction.

Further, the crank handle fixed to the stand is detachable and can be fixed either on the right side or on the left side of the stand, so that it can be operated by either the right hand or the left hand.

The helicopter toy of this invention can be easily manufactured by those skilled in the art with various kinds of materials. However, the main parts of both the helicopter and the launcher are preferably made of plastic materials because of their light weight, abrasion resistance and ease in shaping. And the parts which have to bear strong force should be made of metal.

Now the invention is explained in detail with reference to the drawings representing an embodiment of this invention.

DETAILED DESCRIPTION OF THE INVENTION

Figure 1:
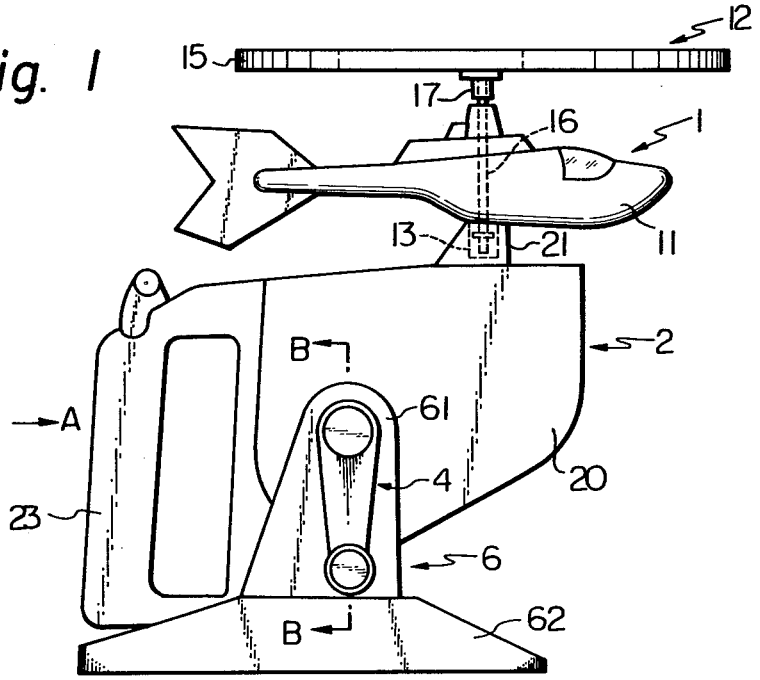
FIG. 1 is a side view showing an embodiment of the helicopter toy of this invention.

In FIG. 1, a helicopter to be launched is shown as 1, a driving apparatus is shown as 2, and member 6 is a stand which comprises a base 62 on which a pair of legs 61, 61' are secured. The driving apparatus 2 is rotatably supported between the legs 61, 61'.

Figure 2:
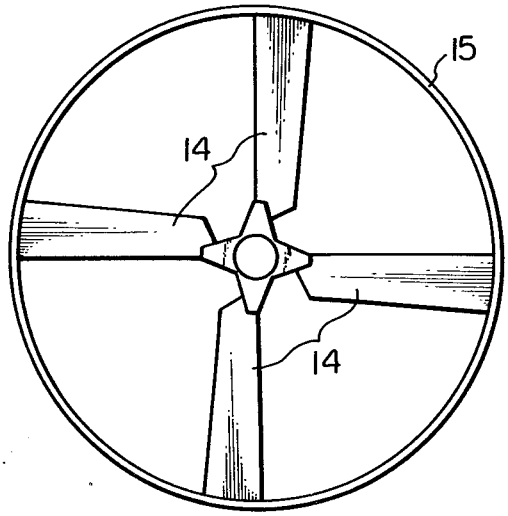
FIG. 2 is a plan view of the rotor of the helicopter.

The helicopter 1 comprises a fuselage 11 and a rotor 12. The rotor has a shaft 16 secured to a hub 17 of the rotor. The shaft vertically extends through the fuselage into a collar 13 (shown in dotted line in FIG. 1) provided at the bottom of the fuselage. The rotor 12 has a safety circumferential ring 15 which is secured to the outer ends of the rotor blades 14, as shown in FIG. 2.

Figure 4:
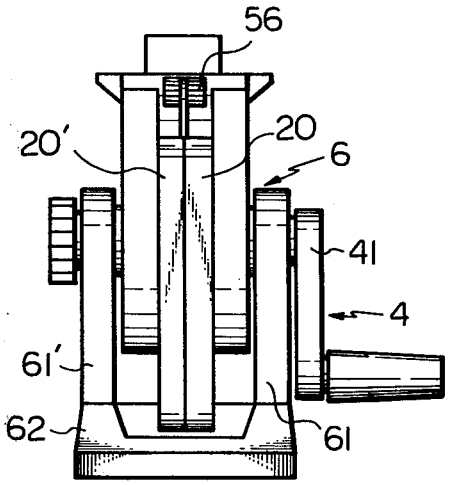
FIG. 4 is a rear view of the driving apparatus and the stand seen in the direction of the arrow A in FIG. 1.

The driving apparatus 2 comprises a pair of casings 20, 20' (20' is shown in FIG. 4, etc.) which forms a housing for the driving mechanism. The rear part of the housing forms a handle 23. In FIG. 1, is seen a crank handle 4, by which a main driving shaft is rotated as explained below. The driving apparatus is further provided with a mount 21 on the top thereof which receives the collar 13 of the fuselage and the lower end of the rotor shaft 16.

FIG. 4 is an elevational rear view of the launcher, that is, the driving apparatus and its stand. In FIG. 4, in addition to the members already mentioned, a lever 41 of the crank handle 4 and a thunb key 56 are seen, the latter being explained in detail later.

Figure 3:
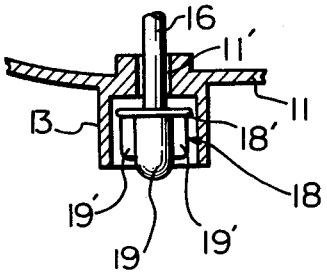
FIG. 3 is a partly cross-sectional side view showing the lower part of the rotor shaft.

FIG. 3 shows the lower part of the rotor shaft 16. The shaft 16 is supported by a hole or bearing 11' provided at the bottom of the fuselage 11. Around the hole is provided a collar 13, which has been mentioned earlier. A supporting member 18 is attached to the end of the shaft. The supporting member 18 comprises a disc 18', a cap 19 and a pair of fins 19' which are diametrically placed.

Figure 5:
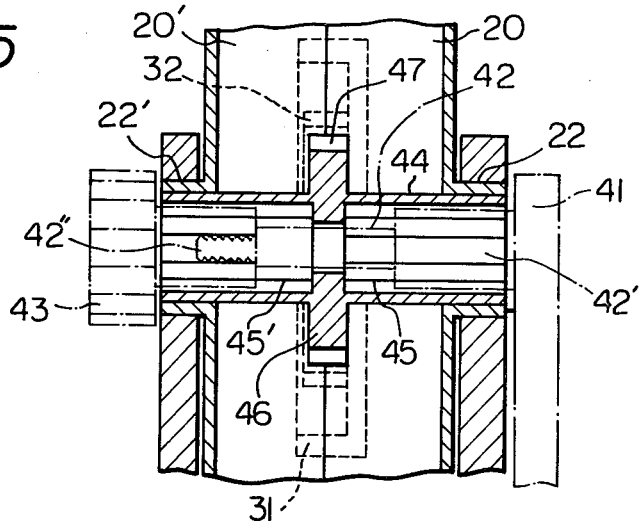
FIG. 5 is a cross-sectional view along the line B—B in FIG. 1.

As seen in FIG. 5, the casings 20, 20′ forming the housing for the driving mechanism have a pair of integrally formed annular flanges 22, 22′, which are rotatably received in circular holes or bearings provided in the legs 61, 61′. A driving cylinder 44 which is provided with an integrally formed large pinion 46 at the center thereof is tightly and rotatably inserted in the annular flanges 22, 22′. In the inside surface of the driving cylinder 44, splines are formed as shown as 45, 45′ in solid lines.

In FIG. 5, the crank handle 4 is shown in one dot chain lines and the lever 41 is shown, too. To the lever 41 a main driving shaft 42 is secured at a right angle thereto. On the base of the shaft 42 splines 42′ are formed. The end part of the main driving shaft 42″ is threaded.

The main driving shaft is inserted into the driving cylinder 44, whereby the splines 42′ interlock with the splines (45 in this case), the shaft per se extends to the left, and the threaded end 42″ is secured by a securing nut 43. The nut can be removed. Also a large gear wheel 31 mounted on the driving cylinder is shown in broken lines in FIG. 5, which is explained in detail below with respect to FIG. 6.

Figure 6:
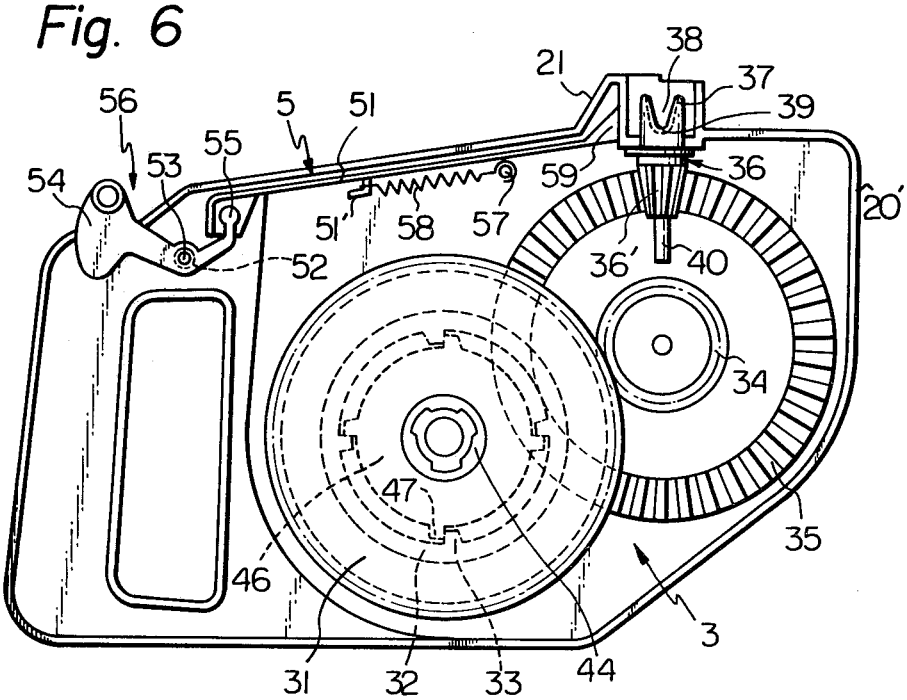
FIG. 6 is a side view showing the driving mechanism of the driving apparatus with one of the casings removed.
Figure 7:
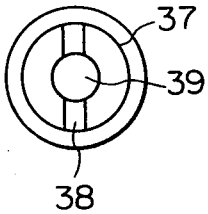
FIG. 7 is a plan view of the rotation shaft.

FIG. 6 is an inside view of the driving apparatus, one of the two casings of which has been removed. An accelerating gear system as the whole is shown as 3. Member 31 is the large gear wheel as mentioned above which has teeth 33 provided on the inside rib thereof and is rotated by meshing with the teeth 47 of the pinion 46 according to the rotation of the driving cylinder 44. Theoretically, the large gear wheel 31 can be formed integrally with the driving cylinder 44. But for the sake of convenience in assembling, they are formed separately. The large gear wheel 31 meshes with a small gear 34 which is rotatably supported by the casings 20, 20′, said small gear 34 being formed integrally with a large bevel wheel 35. The large bevel wheel 35 meshes with a small bevel gear 36′ of a rotation shaft 36, the lower end 40 whereof is rotatably supported by a part of the casing 20. The upper part of the rotation shaft 36 forms a clutch 37, which has indentations 38 to form a notch with a hollow in the center (shown in dotted line). The clutch 37 and indentations 38 disengageably receive the lower part of the shaft 16 of the rotor, which has been explained with respect to FIG. 3. The plan view of the clutch 37 is shown in FIG. 7. That is to say, the cap 19 at the lower part of the rotor shaft 16 is received in the hollow 39 and the fins 19′ engage with the indentations 38.

In the upper part of the driving apparatus 2 is provided a stopper means 5, which retains or releases the fuselage 11. The stopper means comprises a bar 51 which is placed along the ceiling of the housing, and a crank lever 56 is pivotally secured to the casings by means of a pin 53 supported in holes 52 provided in the casing walls and is pivotally connected to the bar 51 by means of a pin 55. The other end of the crank lever 56 forms a thumb key 54. The bar 51 has a hook 51′ and a spring 58 is stretched between the hook 51′ and a pin 57 provided on the wall of the casing 20 so as to pull the bar 51 forward.

Figure 8:
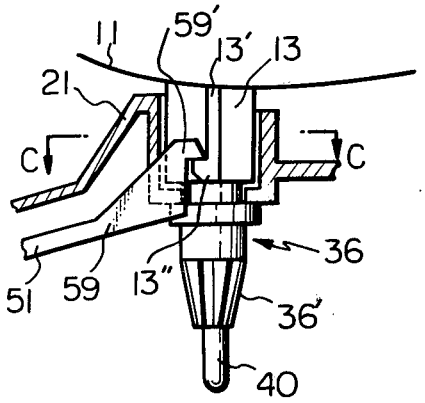
FIG. 8 is a partly cross-sectional side view showing the engagement of the fuselage and the driving apparatus.
Figure 9:
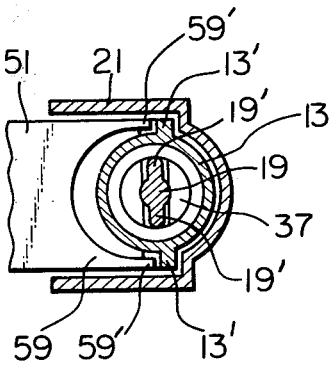
FIG. 9 is a cross-sectional plan view along the line C—C in FIG. 8 showing the engagement of the rotor shaft and the rotation shaft of the driving apparatus.

The front end of the stopper bar 51 is formed into a clutch 59 which has a tooth 59′ at each tip thereof as shown in FIG. 8 and FIG. 9.

The collar 13 which has been explained earlier with respect to FIG. 3 has a pair of fins or diametrical protrusions 13′ as shown in FIG. 8 and FIG. 9. Each protrusion 13′ has a tooth 13″ which interlocks with each tooth 59′ of the stopper bar 51.

Thus, when the helicopter fuselage is placed on the driving apparatus 2 in the same orientation as the latter so that the collar 13 may be received in the mount 21, the teeth 13″ of the collar 13 interlock with the teeth 59′ of the stopper bar and thus the fuselage is held by the launcher. At the same time, the fins 19′ of the supporting member 18 of the rotor shaft 16 automatically engages with the clutch 37 of the rotation shaft 36 of the driving apparatus 2, since the inside surface of the clutch 37 is tapered and curved as seen in FIG. 6. But if the thumb key 54 is pressed down, the stopper is disengaged from the collar 13, and thus the fuselage 11 is released.

Therefore, if the driving apparatus is held by the hand which grasps the handle 23, and the crank handle 4 is rotated by the other hand, the rotation shaft 36 (clutch 37) is rotated and thus the rotor is rotated. But the fuselage is held by the stopper means and, therefore, the helicopter is not launched. As the crank handle 4 is rotated faster and faster, the rotation of the rotor is increased until the rotor rotates so fast that almost no force is required to rotate the crank handle 4. When the rotation of the rotor has reached a desired level, the thumb key 54 of the crank lever 56 is pressed down. Then, the pin 55 pulls the stopper bar 51 backward and disengages the teeth 59′ from the teeth 13″ of the collar 13, and thus the helicopter is launched.

The driving apparatus 2 is rotatably supported between the legs 61, 61′. Therefore, if the helicopter is launched as the driving apparatus is kept horizontal (by holding the handle 23), it rises vertically. If it is launched with the driving apparatus tilted forward, it flies forward as it rises. So the user can select the direction in which the helicopter is to fly depending upon the place where he plays, and also he can adjust the flying range by selecting the rotation speed at which he releases the helicopter. As stated above, the crank handle 4 can be removed by releasing the securing nut 43 from the driving shaft 42. Therefore the crank handle 4 can be attached either on the right side or the left side. Thus a left-handed child can play with this toy without difficulty.

Although the invention has been explained in detail with respect to a preferred embodiment, it should be understood that various modifications are possible within the scope of the invention as defined in the attached claims. Various combinations are possible for the accelerating gear system, for instance.

What I claim is:

1. A helicopter toy comprising, in combination, a toy helicopter and a launcher therefor, said helicopter including a lift rotor and a drive shaft connected thereto and said launcher comprising a housing and a driving apparatus accommodated therein and having an output shaft for driving engagement with said drive shaft to couple the driving apparatus with the lift rotor and thereby bring about rotation thereof, said driving apparatus comprising an elongate driving cylinder mounted rotatably within the housing and having two end portions and an intermediate portion and formed integrally with an externally toothed wheel at said intermediate portion, drive means to bring about rotation of said driving cylinder, a large gear wheel mounted on said driving cylinder and having an annular portion which has an inner periphery and an outer periphery and surrounds said externally toothed wheel and is provided at its inner periphery with teeth which engage the teeth of said externally toothed wheel and connect said large gear wheel drivingly with said externally toothed wheel, said large gear wheel being toothed at its external periphery; and the driving apparatus further comprising a second gear wheel, provided on said output shaft, and gearing connecting the teeth at the external periphery of said large gear wheel drivingly with said second gear wheel.

2. A helicopter toy as claimed in claim 1, wherein at least one of the end portions of the driving cylinder is hollow and is provided as its interior with splines, and the drive means comprise a shaft which is insertable into the interior of said one end portion and is provided at its exterior with splines for engagement with the splines of said one end portion, and a crank handle connected to said shaft for manual drive thereof.

3. A helicopter toy as claimed in claim 2, wherein each of the end portions of the driving cylinder is hollow and is provided at its interior with splines, whereby said shaft can be inserted into the interior of either of said end portions to establish a driving connection between said shaft and said driving cylinder.

4. A helicopter toy as claimed in claim 1, wherein said second gear wheel is a small bevel gear and said gearing comprises a third gear wheel formed with a small pinion which meshes with the teeth at the external periphery of said large gear wheel and a large bevel gear which meshes with said second gear wheel.

5. A helicopter toy as claimed in claim 1, wherein the helicopter has a fuselage through which said drive shaft extends in rotatable manner, and the driving apparatus is further provided with a stopper having an interlocking means which interlocks with an interlocking means provided in the fuselage, is normally pulled by a resilient element so as to effect the interlocking of said interlocking means, and can be disengaged by hand operation.

6. A helicopter toy as claimed in claim 1, wherein said housing comprises two shells which are secured together, each shell being formed with an opening, and wherein said end portions of the driving cylinder are fitted rotatably in said openings respectively.

7. A helicopter toy as claimed in claim 1, wherein said launcher includes a stand and said housing is fitted in the stand so as to be rotatable with respect thereto about a horizontal axis.

8. A helicopter toy as claimed in claim 1, wherein the upper part of the output shaft is provided with a notch to receive the lower end of the drive shaft which is provided with a pair of fins.

9. A helicopter toy as claimed in claim 1, wherein the housing has a handle for grasping the same.

* * * * *